US011918044B2

(12) United States Patent
Batista

(10) Patent No.: US 11,918,044 B2
(45) Date of Patent: Mar. 5, 2024

(54) HEATER AND WICK ASSEMBLY FOR AN AEROSOL GENERATING SYSTEM

(71) Applicant: Altria Client Services LLC, Richmond, VA (US)

(72) Inventor: Rui Nuno Batista, Morges (CH)

(73) Assignee: Altria Client Services LLC, Richmond, VA (US)

( * ) Notice: Subject to any disclaimer, the term of this patent is extended or adjusted under 35 U.S.C. 154(b) by 297 days.

(21) Appl. No.: 16/942,064

(22) Filed: Jul. 29, 2020

(65) Prior Publication Data

US 2020/0352239 A1 Nov. 12, 2020

Related U.S. Application Data

(63) Continuation of application No. 15/609,153, filed on May 31, 2017, now Pat. No. 10,772,354, which is a continuation of application No. PCT/EP2017/062719, filed on May 25, 2017.

(30) Foreign Application Priority Data

May 31, 2016 (EP) ..... 16172208

(51) Int. Cl.

| | |
|---|---|
| ***A24F 40/40*** | (2020.01) |
| ***A24F 40/10*** | (2020.01) |
| ***A24F 40/44*** | (2020.01) |
| ***A24F 40/46*** | (2020.01) |

(52) U.S. Cl.

CPC ..... *A24F 40/40* (2020.01); *A24F 40/44* (2020.01); *A24F 40/46* (2020.01); *A24F 40/10* (2020.01)

(58) Field of Classification Search

None

See application file for complete search history.

(56) References Cited

U.S. PATENT DOCUMENTS

| | | | |
|---|---|---|---|
| 2,291,067 | A | 7/1942 | Atkins |
| 2,302,146 | A | 11/1942 | Root et al. |
| 2,795,945 | A | 6/1957 | Coenders |
| 2,829,511 | A | 4/1958 | Oesterle et al. |
| 3,462,235 | A | 8/1969 | Summers |

(Continued)

FOREIGN PATENT DOCUMENTS

| | | | |
|---|---|---|---|
| CN | 101516425 | A | 8/2009 |
| CN | 103338664 | A | 10/2013 |

(Continued)

OTHER PUBLICATIONS

Japanese Office Action dated Apr. 26, 2021 for corresponding Japanese Application No. 2018-558385, and English-language translation thereof.

(Continued)

*Primary Examiner* — Thor S Campbell

(74) *Attorney, Agent, or Firm* — Harness, Dickey & Pierce, P.L.C.

(57) ABSTRACT

A heater and wick assembly for an aerosol generating system includes a capillary body, a heating element on an outer surface of the capillary body, and a pair of spaced apart electrical contacts fixed around the capillary body and coupled with the heating element. The heater and wick assembly also includes a support member extending along at least part of the length of the capillary body.

17 Claims, 8 Drawing Sheets

(56) References Cited

U.S. PATENT DOCUMENTS

| | | | | |
|---|---|---|---|---|
| 3,917,441 | A | 11/1975 | Gray | |
| 4,099,916 | A | 7/1978 | Gardner et al. | |
| 10,285,444 | B2 * | 5/2019 | Clemens | A24F 47/008 |
| 2005/0034723 | A1 * | 2/2005 | Bennett | A61K 9/007 128/203.12 |
| 2008/0038363 | A1 * | 2/2008 | Zaffaroni | A61M 11/041 424/502 |
| 2010/0181387 | A1 * | 7/2010 | Zaffaroni | A61M 15/06 239/13 |
| 2012/0260927 | A1 * | 10/2012 | Liu | A24F 47/008 131/329 |
| 2013/0192619 | A1 | 8/2013 | Tucker et al. | |
| 2014/0205272 | A1 | 7/2014 | Midgette et al. | |
| 2014/0224267 | A1 * | 8/2014 | Levitz | A24F 47/008 131/329 |
| 2014/0270729 | A1 * | 9/2014 | DePiano | A24F 47/008 392/397 |
| 2014/0270730 | A1 | 9/2014 | DePiano et al. | |
| 2015/0083147 | A1 | 3/2015 | Schiff et al. | |
| 2015/0320116 | A1 * | 11/2015 | Bleloch | A61M 15/06 219/628 |
| 2016/0150828 | A1 * | 6/2016 | Goldstein | A24F 47/008 392/387 |
| 2016/0324218 | A1 * | 11/2016 | Wang | A24F 47/00 |
| 2017/0188626 | A1 * | 7/2017 | Davis | A24F 47/008 |
| 2017/0251719 | A1 * | 9/2017 | Cyphert | A24F 1/00 |
| 2018/0070639 | A1 * | 3/2018 | Chen | A24F 47/008 |
| 2018/0184712 | A1 * | 7/2018 | Fraser | A24F 47/008 |
| 2018/0192700 | A1 * | 7/2018 | Fraser | A24F 47/008 |
| 2019/0124979 | A1 * | 5/2019 | Sebastian | H05B 6/108 |
| 2019/0200677 | A1 * | 7/2019 | Chong | A24F 47/008 |
| 2019/0230987 | A1 * | 8/2019 | Wu | A24F 47/008 |
| 2019/0387797 | A1 | 12/2019 | Christensen et al. | |

FOREIGN PATENT DOCUMENTS

| | | | |
|---|---|---|---|
| CN | 103859605 | A | 6/2014 |
| CN | 203776163 | U | 8/2014 |
| CN | 104161308 | A | 11/2014 |
| CN | 105357994 | A | 2/2016 |
| EP | 2113178 | A1 | 11/2009 |
| EP | 2340729 | A1 | 7/2011 |
| EP | 02779786 | A1 | 9/2014 |
| GB | 2513637 | A | 11/2014 |
| JP | 2015-50025 | A | 3/2015 |
| JP | 2016-511008 | A | 4/2016 |
| KR | 20150130460 | A | 11/2015 |
| WO | WO-2009/132793 | A1 | 11/2009 |
| WO | WO-2015/117700 | A1 | 8/2015 |
| WO | WO-2015140012 | A1 | 9/2015 |
| WO | WO-2016033891 | A1 | 3/2016 |

OTHER PUBLICATIONS

Russian Notice of Allowance and Search Report for corresponding Application No. 2018142137, dated Jul. 2, 2020.

Chinese Office Action dated Jan. 28, 2021 for corresponding Chinese Application No. 201780028190.X, and English-language translation thereof.

Chinese Office Action dated Nov. 26, 2021 for corresponding Chinese Application No. 201780028190, and English-language translation thereof.

Office Action dated May 17, 2022 issued in corresponding Korean patent application No. 10-2018-7032211.

Japanese Notice of Allowance dated Oct. 6, 2021 for corresponding Japanese Application No. 2018-558385, and English-language translation thereof.

Extended European Search Report #16172208.7 dated Nov. 18, 2016.

International Search Report and Written Opinion for corresponding International Application No. PCT/EP2017/062719 dated Aug. 3, 2017.

Korean Notice of Allowance for corresponding Application No. 10-2018-7032211, dated Nov. 21, 2022, with English translation included.

* cited by examiner

HEATER AND WICK ASSEMBLY FOR AN AEROSOL GENERATING SYSTEM

CROSS-REFERENCE TO RELATED APPLICATIONS

This application is a continuation U.S. application Ser. No. 15/609,153, filed May 31, 2017, which is a continuation of, and claims priority to, international application no. PCT/EP2017/062719, filed on May 25, 2017, and further claims priority under 35 U.S.C. § 119 to European Patent Application No. 16172208.7, filed May 31, 2016, the entire contents of each of which are incorporated herein by reference.

BACKGROUND

Field

Example embodiments relate to heater and wick assemblies for aerosol generating systems that incorporate a heating element and capillary body. The disclosure also relates to methods of producing such heater and wick assemblies.

Description of Related Art

Electrically heated smoking systems may be handheld and may operate by heating a liquid aerosol-forming substrate in a capillary wick. WO2009/132793, the entire content of which is incorporated herein by reference thereto, describes an electrically heated smoking system comprising a shell and a replaceable mouthpiece. The shell comprises an electric power supply and electric circuitry. The mouthpiece comprises a liquid storage portion and a capillary wick having a first end and a second end. The first end of the wick extends into the liquid storage portion for contact with liquid therein. The mouthpiece also comprises a heating element for heating the second end of the capillary wick, an air outlet, and an aerosol-forming chamber between the second end of the capillary wick and the air outlet. Liquid is transferred from the liquid storage portion towards the heating element by capillary action in the wick

SUMMARY

At least one example embodiment relates to a heater and wick assembly for an aerosol generating system.

In at least one example embodiment a heater and wick assembly comprises: a capillary body; a heating element arranged on an outer surface of the capillary body; a pair of spaced apart electrical contacts fixed around the capillary body and coupled with the heating element, and a support member extending along at least part of the length of the capillary body.

The electrical contacts are positioned over the heating element. By fixing the electrical contacts around the capillary body and over the heating element, the electrical contacts may secure the heating element to the outer surface of the capillary body. That is, the electrical contacts may hold at least part of the heating element in place on the outer surface of the capillary body. With this arrangement, the electrical contacts may secure the heating element to the capillary body as well as provide an electrical connection by which the heating element may be connected to a source of electrical energy. The heater and wick assembly may be manufactured on an automated assembly line, so such devices can be manufactured more quickly with high repeatability.

BRIEF DESCRIPTION OF THE DRAWINGS

The invention will be further described, by way of example only, with reference to the accompanying drawings.

DETAILED DESCRIPTION

Figure 1A:
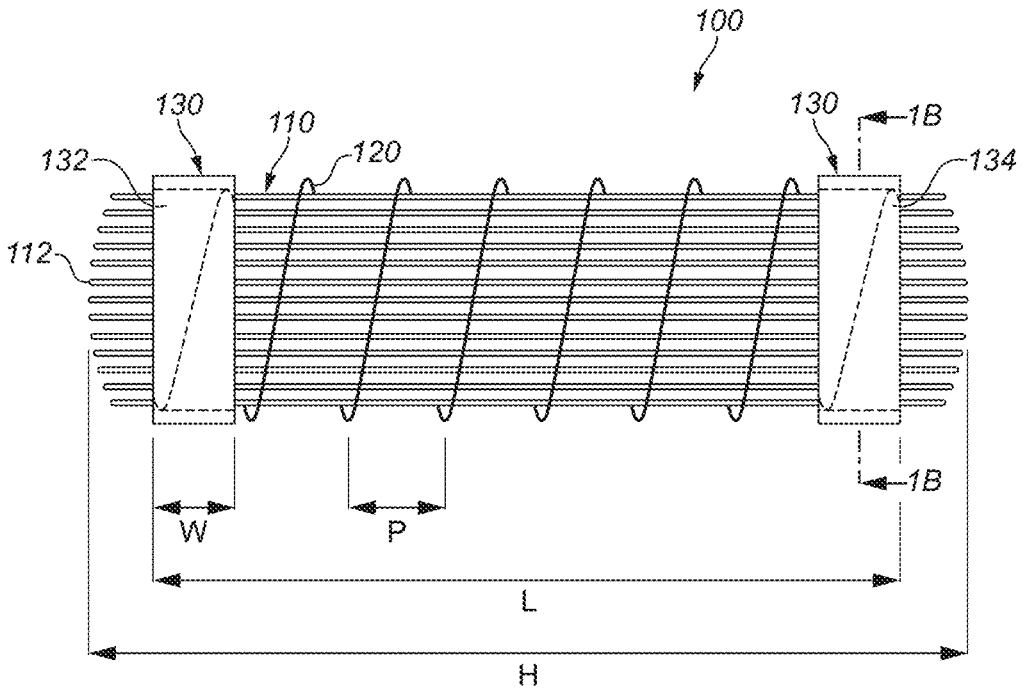
FIG. 1A is a side view of a heater and wick assembly according to at least one example embodiment.

Example embodiments will become more readily understood by reference to the following detailed description of the accompanying drawings. Example embodiments may, however, be embodied in many different forms and should not be construed as being limited to the example embodiments set forth herein. Rather, these example embodiments are provided so that this disclosure will be thorough and complete. Like reference numerals refer to like elements throughout the specification.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises," "comprising," "includes," and/or "including," when used in this specification, specify the presence of stated features, integers, steps, operations, elements, and/or components, but do not preclude the presence or addition of one or more other features, integers, steps, operations, elements, components, and/or groups thereof.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on", "directly connected to" or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings set forth herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Example embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, these example embodiments should not be construed as limited to the particular shapes of regions illustrated herein, but are to include deviations in shapes that result, for example, from manufacturing. For example, an implanted region illustrated as a rectangle will, typically, have rounded or curved features and/or a gradient of implant concentration at its edges rather than a binary change from implanted to non-implanted region. Likewise, a buried region formed by implantation may result in some implantation in the region between the buried region and the surface through which the implantation takes place. Thus, the regions illustrated in the figures are schematic in nature and their shapes are not intended to illustrate the actual shape of a region of a device and are not intended to limit the scope of this disclosure.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and this specification and will not be interpreted in an idealized or overly formal sense unless expressly so defined herein.

Unless specifically stated otherwise, or as is apparent from the discussion, terms such as "processing" or "computing" or "calculating" or "determining" or "displaying" or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

In the following description, illustrative embodiments may be described with reference to acts and symbolic representations of operations (e.g., in the form of flow charts, flow diagrams, data flow diagrams, structure diagrams, block diagrams, etc.) that may be implemented as program modules or functional processes including routines, programs, objects, components, data structures, etc., that perform particular tasks or implement particular abstract data types. The operations be implemented using existing hardware in existing electronic systems, such as one or more microprocessors, Central Processing Units (CPUs), digital signal processors (DSPs), application-specific-integrated-circuits (ASICs), SoCs, field programmable gate arrays (FPGAs), computers, or the like.

Further, one or more example embodiments may be (or include) hardware, firmware, hardware executing software, or any combination thereof. Such hardware may include one or more microprocessors, CPUs, SoCs, DSPs, ASICs, FPGAs, computers, or the like, configured as special purpose machines to perform the functions described herein as well as any other well-known functions of these elements. In at least some cases, CPUs, SoCs, DSPs, ASICs and FPGAs may generally be referred to as processing circuits, processors and/or microprocessors.

Although processes may be described with regard to sequential operations, many of the operations may be performed in parallel, concurrently or simultaneously. In addition, the order of the operations may be re-arranged. A process may be terminated when its operations are completed, but may also have additional steps not included in the figure. A process may correspond to a method, function, procedure, subroutine, subprogram, etc. When a process corresponds to a function, its termination may correspond to a return of the function to the calling function or the main function.

As disclosed herein, the term "storage medium", "computer readable storage medium" or "non-transitory computer readable storage medium," may represent one or more devices for storing data, including read only memory (ROM), random access memory (RAM), magnetic RAM, core memory, magnetic disk storage mediums, optical storage mediums, flash memory devices and/or other tangible machine readable mediums for storing information. The term "computer-readable medium" may include, but is not limited to, portable or fixed storage devices, optical storage devices, and various other mediums capable of storing, containing or carrying instruction(s) and/or data.

Furthermore, at least some portions of example embodiments may be implemented by hardware, software, firmware, middleware, microcode, hardware description languages, or any combination thereof. When implemented in software, firmware, middleware or microcode, the program code or code segments to perform the necessary tasks may be stored in a machine or computer readable medium such as a computer readable storage medium. When implemented in software, processor(s), processing circuit(s), or processing unit(s) may be programmed to perform the necessary tasks, thereby being transformed into special purpose processor(s) or computer(s).

A code segment may represent a procedure, function, subprogram, program, routine, subroutine, module, software package, class, or any combination of instructions, data structures or program statements. A code segment may be coupled to another code segment or a hardware circuit by passing and/or receiving information, data, arguments, parameters or memory contents. Information, arguments, parameters, data, etc. may be passed, forwarded, or transmitted via any suitable means including memory sharing, message passing, token passing, network transmission, etc.

In at least one example embodiment, a heater and wick assembly comprises: a capillary body; a heating element arranged on an outer surface of the capillary body; a pair of spaced apart electrical contacts fixed around the capillary body and coupled with the heating element, and a support member extending along at least part of the length of the capillary body.

The electrical contacts are positioned over the heating element. By fixing the electrical contacts around the capillary body and over the heating element, the electrical contacts may secure the heating element to the outer surface of the capillary body. That is, the electrical contacts may hold at least part of the heating element in place on the outer surface of the capillary body. With this arrangement, the electrical contacts may secure the heating element to the capillary body as well as provide an electrical connection by which the heating element may be connected to a source of electrical energy. The heater and wick assembly may be manufactured on an automated assembly line, so such devices can be manufactured more quickly with high repeatability.

In at least one example embodiment, at least one of the electrical contacts is dimensioned such that there is a frictional fit between an inner surface of that electrical contact and the outer surface of the capillary body. Providing such a frictional fit may allow the electrical contact to be secured on the capillary body without the need for additional fastening means or fastening steps. In at least one example embodiment, each electrical contact is dimensioned such that there is a frictional fit between the inner surface of the electrical contact and the outer surface of the capillary body.

In at least one example embodiment, the electrical contacts may be fixed to the outer surface of the capillary body using an adhesive or similar fastening means.

The electrical contacts may extend around at least part of the circumference of the capillary body. The capillary body may be compressible. At least one of the electrical contacts may be dimensioned such that there is an interference fit between the electrical contact and the capillary body. That is, the electrical contact may be dimensioned such that its inner surface defines an internal space having a diameter which is less than the outer diameter of the capillary body so the capillary body is compressed by the electrical contact to secure the electrical contact to the capillary body. The capillary body may be compressible and at least one of the electrical contacts may extend around at least part of the circumference of the capillary body and be dimensioned such that there is an interference fit between the electrical contact and the capillary body. This may help to ensure that the heating element is securely fixed to the capillary body by the electrical contact without the need for adhesive or additional fixation steps, such as soldering or welding. It may also help to ensure a reliable electrical connection between the electrical contact and the heating element. In such embodiments, both of the electrical contacts may extend around at least part of the circumference of the capillary body and each may be dimensioned such that there is an interference fit between the electrical contact and the capillary body.

The electrical contacts may extend around only part of the circumference of the capillary body. The electrical contacts extend around more than about 50 percent of the circumference of the capillary body. This may result in a more secure fixation of the electrical contacts to the capillary body relative to example embodiments in which the electrical contacts extend around less than about 50 percent of the circumference of the capillary body. It may also help to ensure a reliable electrical connection between the electrical contact and the heating element.

One or both of the electrical contacts may extend around substantially the entire circumference of the capillary body. At least one of the electrical contacts may circumscribe the capillary body. In such example embodiments, the electrical contact may be ring shaped. In at least one example embodiment, both electrical contacts circumscribe the capillary body. This may result in a more secure fixation of the electrical contacts to the capillary body relative to example embodiments in which the electrical contacts extend around less than the entire circumference of the capillary body. It may also help to ensure a reliable electrical connection between the electrical contact and the heating element irrespective of the specific arrangement of the heating element on the outer surface of the capillary body and without restricting the arrangement of the heating element to ensure contact between the electrical contacts and the heating element.

Both electrical contacts may circumscribe the capillary body and be dimensioned such that there is an interference fit between the electrical contacts and the capillary body.

The electrical contacts may be rigid. This may result in a more robust assembly than one in which the electrical contacts are flexible. The electrical contacts may be rigid, extend around more than about 50 percent of the circumference of the capillary body and be dimensioned such that there is a frictional fit between the capillary body and the electrical contacts. This may allow the electrical contacts simply to be clipped around the capillary body during assembly.

The electrical contacts may each comprise a ring of rigid material, such as a metallic ring. This may provide an electrical contact with high mechanical resistance and reliable electrical connection to the heating element. It may also enable the heater and wick assembly to be connected to a supply of electrical energy in an aerosol generating device by snap fitting the electrical contacts into a retaining clip in the device. Where the electrical contacts extend around the circumference of the capillary body, each electrical contact may be formed from a bent sheet of material, the opposed ends of which are connected together at a joint. For example, the opposed ends may be connected together at the joint by snap fitting or clamping. This may provide a robust assembly which does not require welding.

Where the electrical contacts extend around the circumference of the capillary body, the opposed ends of each electrical contact may be co-operatively shaped such that the joint is non-linear or extends along an oblique line. In this context, the term "oblique line" means that the joint extends along a line which is nonparallel to the longitudinal axis of the capillary body. By having a joint which is non-linear or extending along an oblique line, relative movement between the opposed ends of each electrical contact in the longitudinal direction of the capillary body may be substantially prevented and/or reduced.

The electrical contacts may be flexible. In at least one example embodiment, the electrical contacts may be formed from a flexible sheet of electrically conductive material, such as a metal foil. In such example embodiments, the electrical contacts may be secured to the outer surface of the capillary body using an adhesive or similar, or extend around the entire circumference of the capillary body such that there is a frictional fit between the capillary body and the electrical contacts.

In any of the example embodiments, the heating element may comprise a coil of electrically resistive wire wound around the capillary body. In such example embodiments, the coil of electrically resistive wire may be wound around the capillary body along the entire length of the capillary body.

The capillary body may be any suitable shape. The capillary body may be elongate. The pair of electrical contacts may be spaced apart in a length direction of the capillary body. In such example embodiments, the pair of electrical contacts may be positioned at any location along the length of the capillary body. In at least one example embodiment, the pair of electrical contacts may comprise a first electrical contact at or adjacent to a first end of the capillary body and a second electrical contact at any other location, such as at a midpoint along the length of the capillary body. The pair of electrical contacts may comprise a first electrical contact at or adjacent to a first end of the capillary body and a second electrical contact at or adjacent to the second end of the capillary body.

The heater and wick assembly comprises a support member extending along at least part of the length of the capillary body. The support member is stronger and stiffer than the capillary body. With this arrangement, the support member may increase the strength and rigidity of the heater and wick assembly to improve robustness and ease of handling. In manufacturing operations in which individual heater and wick assemblies are cut from a multi-length heater and wick assembly, the support member may result in improved accuracy of the cutting operation. This may lead to greater repeatability and consistency between different heater and wick assemblies.

The support member may be formed from a single, unitary component or from a plurality of components connected together.

In at least one example embodiment, the support member is located within the capillary body. The support member may extend through the core of the capillary body. The support member may be surrounded by the capillary body. The support member may be circumscribed by the capillary body. The presence of the rigid support member may reduce the overall radial compressibility of the capillary body, thus helping to ensure a tight fit between the electrical contacts and the heating element. The support member may be arranged on an outer surface of the capillary body.

In at least one example embodiment, the support member is a rigid support member.

In at least one example embodiment, the support member may extend along only part of the length of the capillary body. In some example embodiments, the support member extends along substantially the entire length of the capillary body.

In at least one example embodiment, the support member may have any suitable cross-sectional area. In some example embodiments, the support member has a cross-sectional area which is less than about 3 to about 21 percent of the total cross sectional area of the capillary body, or less than about 4 to about 16 percent of the cross-sectional area of the capillary body.

The support member may have any suitable cross-sectional shape. For example, the support member may have a planar, circular, oval, square, rectangular, triangular, or similar cross-sectional shape. The support member may have a solid cross-sectional area. The support member may have a hollow cross-sectional area.

In some example embodiments, the support member may comprise a central portion and a plurality of transverse ribs. This cross-sectional shape may result in a support member having a suitable rigidity without occupying a large amount of space within the capillary body and thus significantly reducing the wicking ability of the capillary body. The plurality of transverse ribs may comprise a plurality of radially extending ribs. In at least one example embodiment, the support member may comprise a central portion and three or more radially extending ribs. This may provide support member which is resistant to bending in all transverse directions.

In some example embodiments, the support member is formed from an electrical insulative material. This may substantially prevent and/or reduce the core component from impacting on the electrical performance of the heating element if it comes into contact with the heating element or the electrical contacts. The support member may be formed from an electrically conductive material.

In at least one example embodiment, the electrical contacts are fixed around the capillary body and are coupled with the heating element. Thus, the electric contacts may allow the heating element to be electrically connected to a supply of electrical energy. In at least one example embodiment, the electrical contacts have a lower electrical resistance than the electrical resistance of the heating element, so as to substantially prevent and/or reduce damage to the electrical contacts when the heating element is energized. In such example embodiments, the electrical contacts may each have a larger cross-sectional area than the cross-sectional area of the heating element to which it is electrically connected. The electrical contacts may be formed from a material having a lower resistivity than a material from which the heating element is formed. Suitable materials for forming the electrical contacts include aluminium, copper, zinc, silver, stainless steel, such as austenitic 316 stainless steel and martensitic 440 and 420 stainless steel, and alloys thereof.

In at least one example embodiment, the heating element may be a coil of electrically resistive wire. The heating element may be formed by stamping or etching a sheet blank that can be subsequently wrapped around a wick. In at least one example embodiment, the heating element is a coil of electrically resistive wire. The pitch of the coil may range from about 0.5 mm to about 1.5 mm, or may be about 1.5 mm. The pitch of the coil means the spacing between adjacent turns of the coil. The coil may comprise fewer than six turns or fewer than five turns. The electrically resistive wire has a diameter of about 0.10 mm to about 0.15 mm, or about 0.125 mm. The electrically resistive wire is formed of 904 or 301 stainless steel. Examples of other suitable metals include titanium, zirconium, tantalum and metals from the platinum group. Examples of other suitable metal alloys include, Constantan, nickel-, cobalt-, chromium-, aluminium- titanium- zirconium-, hafnium-, niobium-, molybdenum-, tantalum-, tungsten-, tin-, gallium-, manganese- and iron-containing alloys, and super-alloys based on nickel, iron, cobalt, stainless steel, Timetal®, iron-aluminium based alloys and iron-manganese-aluminium based alloys. Timetal® is a registered trade mark of Titanium Metals Corporation, 1999 Broadway Suite 4300, Denver Colo. In composite materials, the electrically resistive material may optionally be embedded in, encapsulated or coated with an insulating material or vice-versa, depending on the kinetics of energy transfer and the external physicochemical properties required. The heating element may comprise a metallic etched foil insulated between two layers of an inert material. In that case, the inert material may comprise Kapton®, all-polyimide or mica foil. Kapton® is a registered trade mark of E.I. du Pont de Nemours and Company, 1007 Market Street, Wilmington, Del. 19898, United States of America. The heating element may also comprise a metal foil, e.g., an aluminium foil, which is provided in the form of a ribbon.

In at least one example embodiment, the heating element may operate by resistive heating. In other words the material and dimensions of the heating element may be chosen so that when a particular current is passed through the heating element the temperature of the heating element is raised to a desired (or, alternatively predetermined) temperature. The current through the heating element may be applied by conduction from a battery or may be induced in the heating element by the application of a variable magnetic field around the heating element.

In at least one example embodiment, the heater and wick assembly may comprise more than one heating element, for example two, or three, or four, or five, or six or more heating elements.

In at least one example embodiment, the capillary body may comprise any suitable material or combination of materials which is able to convey a liquid aerosol-forming substrate along its length. The capillary body may be formed from a porous material, but this need not be the case. The capillary body may be formed from a material having a fibrous or spongy structure. The capillary body comprises a bundle of capillaries. In at least one example embodiment, the capillary body may comprise a plurality of fibres or threads or other fine bore tubes. The capillary body may comprise sponge-like or foam-like material. The structure of the capillary body forms a plurality of small bores or tubes, through which an aerosol-forming liquid can be transported by capillary action. The particular material or materials will depend on the physical properties of the aerosol-forming substrate. Examples of suitable capillary materials include a sponge or foam material, ceramic- or graphite-based materials in the form of fibres or sintered powders, foamed metal or plastics material, a fibrous material, for example made of spun or extruded fibres, such as cellulose acetate, polyester, or bonded polyolefin, polyethylene, terylene or polypropylene fibres, nylon fibres, ceramic, glass fibres, silica glass fibres, carbon fibres, metallic fibres of medical grade stainless steel alloys such as austenitic 316 stainless steel and martensitic 440 and 420 stainless steels. The capillary body may have any suitable capillarity so as to be used with different liquid physical properties. The liquid has physical properties, including, but not limited to, viscosity, surface tension, density, thermal conductivity, boiling point and vapour pressure, which allow the liquid to be transported through the capillary body. The capillary body may be formed from heat-resistant material. The capillary body may comprise a plurality of fibre strands. The plurality of fibre strands may be generally aligned along the length of the capillary body.

At least one example embodiment relates to a heater and wick assembly for an aerosol generating system. The assembly comprising: a capillary body; a heating element arranged on an outer surface of the capillary body; and a pair of spaced apart electrical contacts fixed around the capillary body and coupled with the heating element.

In at least one example embodiment, an aerosol generating system comprises: a heater and wick assembly according to any of the example embodiments described herein; a liquid storage portion in fluid communication with the capillary body; and an electric power supply connected to the heating element via the electrical contacts.

In at least one example embodiment, the electrical contacts may each comprise one or more outwardly extending tabs and the system may further comprise a housing having one or more ports into which the tabs are received and retained. The tab of each electrical contact may allow the contact, and thus the heater and wick assembly, to be fastened easily to the housing and in the correct position. The one or more ports may comprise electrical connections connected to the electric power supply. With this arrangement, the tabs may facilitate electrical connection of the electrical contacts to the power supply. The one or more tabs are planar. The planar tabs provide a flat surface with which the heater and wick assembly may be located and retained within the aerosol-generating system. The flat surface of the planar tabs may also facilitate electrical connection of the electrical contacts to the power supply by presenting a larger electrically conductive surface area than with electrical contacts which do not have outwardly extending, planar tabs.

The aerosol generating system may be an electrically heated smoking system. In at least one example embodiment, the aerosol-generating system is hand held. The aerosol-generating system may be an electrically heated smoking system and may have a size comparable to a conventional cigar or cigarette. The smoking system may have a total length ranging from about 30 mm to about 150 mm. The smoking system may have an external diameter ranging from about 5 mm to about 30 mm.

In at least one example embodiment, the system comprises a liquid storage portion in fluid communication with the capillary body of the heater and wick assembly. The liquid storage portion of the aerosol-generating system may comprise a housing that is substantially cylindrical. An opening is at one end of the cylinder. The housing of the liquid storage portion may have a substantially circular cross section. The housing may be a rigid housing. As used herein, the term 'rigid housing' is used to mean a housing that is self-supporting. The liquid storage portion may contain an aerosol forming liquid.

In at least one example embodiment, the liquid storage portion may comprise a carrier material for holding the aerosol-forming substrate.

In at least one example embodiment, the liquid aerosol-forming substrate may be adsorbed or otherwise loaded onto a carrier or support. The carrier material may be made from any suitable absorbent plug or body, for example, a foamed metal or plastics material, polypropylene, terylene, nylon fibres or ceramic. The liquid aerosol-forming substrate may be retained in the carrier material prior to use of the aerosol-generating system. The liquid aerosol-forming substrate may be released into the carrier material during use. The liquid aerosol-forming substrate may be released into the carrier material immediately prior to use. In at least one example embodiment, the liquid aerosol-forming substrate may be provided in a capsule. The shell of the capsule may melt upon heating by the heating means and releases the liquid aerosol-forming substrate into the carrier material. The capsule may optionally contain a solid in combination with the liquid.

In at least one example embodiment, the liquid aerosol-forming substrate is held in capillary material. A capillary material is a material that actively conveys liquid from one end of the material to another. The capillary material may be oriented in the storage portion to convey liquid aerosol-forming substrate to the heater and wick assembly. The capillary material may have a fibrous structure. The capillary material may have a spongy structure. The capillary material may comprise a bundle of capillaries. The capillary material may comprise a plurality of fibres. The capillary material may comprise a plurality of threads. The capillary material may comprise fine bore tubes. The capillary material may comprise a combination of fibres, threads and fine-bore tubes. The fibres, threads and fine-bore tubes may be generally aligned to convey liquid to the heater and wick assembly. The capillary material may comprise sponge-like material. The capillary material may comprise foam-like material. The structure of the capillary material may form a plurality of small bores or tubes, through which the liquid can be transported by capillary action.

In at least one example embodiment, the capillary material may comprise any suitable material or combination of materials. Examples of suitable materials are a sponge or foam material, ceramic- or graphite-based materials in the form of fibres or sintered powders, foamed metal or plastics materials, a fibrous material, for example made of spun or extruded fibres, such as cellulose acetate, polyester, or bonded polyolefin, polyethylene, terylene or polypropylene fibres, nylon fibres or ceramic. The capillary material may have any suitable capillarity and porosity so as to be used with different liquid physical properties. The liquid aerosol-forming substrate has physical properties, including but not limited to viscosity, surface tension, density, thermal conductivity, boiling point and atom pressure, which allow the liquid to be transported through the capillary material by capillary action. The capillary material may be configured to convey the aerosol-forming substrate to the atomiser.

The storage portion may comprise a fluid permeable internal surface surrounding an open-ended passage. The storage portion preferably comprises a capillary wick forming part or all of the internal surface for transporting aerosol-forming liquid from the storage portion to a heater assembly positioned within the open-ended passage.

In at least one example embodiment, the storage portion contains an aerosol-forming liquid.

In at least one example embodiment, the liquid aerosol-forming substrate may comprise nicotine. The nicotine containing liquid aerosol-forming substrate may be a nicotine salt matrix. The liquid aerosol-forming substrate may comprise plant-based material. The liquid aerosol-forming substrate may comprise tobacco. The liquid aerosol-forming substrate may comprise a tobacco-containing material containing volatile tobacco flavour compounds, which are released from the aerosol-forming substrate upon heating. The liquid aerosol-forming substrate may comprise homogenised tobacco material. The liquid aerosol-forming substrate may comprise a non-tobacco-containing material. The liquid aerosol-forming substrate may comprise homogenised plant-based material.

In at least one example embodiment, the liquid aerosol-forming substrate may comprise at least one aerosol-former. An aerosol-former is any suitable known compound or mixture of compounds that, in use, facilitates formation of a dense and stable aerosol and that is substantially resistant to thermal degradation at the temperature of operation of the system. Suitable aerosol-formers are well known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Aerosol formers may be polyhydric alcohols or mixtures thereof, such as triethylene glycol, 1,3-butanediol and glycerine. The liquid aerosol-forming substrate may comprise other additives and ingredients, such as flavourants.

In at least one example embodiment, the aerosol-forming substrate may comprise nicotine and at least one aerosol former. The aerosol former may be glycerine. The aerosol-former may be propylene glycol. The aerosol former may comprise both glycerine and propylene glycol. The aerosol-forming substrate may have a nicotine concentration ranging from about 2% to about 10%.

Although reference is made to liquid aerosol-forming substrates above, other forms of aerosol-forming substrate may be used with other example embodiments. In at least one example embodiment, the aerosol-forming substrate may be a solid aerosol-forming substrate. The aerosol-forming substrate may comprise both solid and liquid components. The aerosol-forming substrate may comprise a tobacco-containing material containing volatile tobacco flavour compounds which are released from the substrate upon heating. The aerosol-forming substrate may comprise a non-tobacco material. The aerosol-forming substrate may further comprise an aerosol former. Examples of suitable aerosol formers are glycerine and propylene glycol.

In at least one example embodiment, if the aerosol-forming substrate is a solid aerosol-forming substrate, the solid aerosol-forming substrate may comprise, for example, one or more of: powder, granules, pellets, shreds, spaghettis, strips or sheets containing one or more of: herb leaf, tobacco leaf, fragments of tobacco ribs, reconstituted tobacco, homogenised tobacco, extruded tobacco, cast leaf tobacco and expanded tobacco. The solid aerosol-forming substrate may be in loose form, or may be provided in a suitable container or cartridge. Optionally, the solid aerosol-forming substrate may contain additional tobacco or non-tobacco volatile flavour compounds, to be released upon heating of the substrate. The solid aerosol-forming substrate may also contain capsules that, for example, include the additional tobacco or non-tobacco volatile flavour compounds and such capsules may melt during heating of the solid aerosol-forming substrate.

As used herein, homogenised tobacco refers to material formed by agglomerating particulate tobacco. Homogenised tobacco may be in the form of a sheet. Homogenised tobacco material may have an aerosol-former content of greater than about 5% on a dry weight basis. Homogenised tobacco material may alternatively have an aerosol former content ranging from about 5% to about 30% by weight on a dry weight basis. Sheets of homogenised tobacco material may be formed by agglomerating particulate tobacco obtained by grinding or otherwise comminuting one or both of tobacco leaf lamina and tobacco leaf stems. Alternatively, or in addition, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco; alternatively, or in addition, sheets of homogenised tobacco material may comprise other additives including, but not limited to, tobacco and non-tobacco fibres, aerosol-formers, humectants, plasticisers, flavourants, fillers, aqueous and non-aqueous solvents and combinations thereof.

Optionally, the solid aerosol-forming substrate may be provided on or embedded in a thermally stable carrier. The carrier may take the form of powder, granules, pellets, shreds, spaghettis, strips or sheets. In at least one example embodiment, the carrier may be a tubular carrier having a thin layer of the solid substrate deposited on its inner surface, or on its outer surface, or on both its inner and outer surfaces. Such a tubular carrier may be formed of, for example, a paper, or paper like material, a non-woven carbon fibre mat, a low mass open mesh metallic screen, or a perforated metallic foil or any other thermally stable polymer matrix.

In at least one example embodiment, the solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

The aerosol-generating system may consist of an aerosol generating device and a removable aerosol-generating article for use with the device. In at least one example embodiment, the aerosol-generating article may comprise a cartridge or smoking article. The aerosol-generating article comprises the storage portion. The device may comprise a power supply and the electric circuitry. The heating and wick assembly may form part of the device or the article, or both the device and the article.

In at least one example embodiment, the system may comprise a cartridge removably coupled to an aerosol-generating device. The cartridge may be removed from the aerosol-generating device when the aerosol-forming substrate has been consumed. The cartridge may be disposable. The cartridge may be reusable. The cartridge may be refillable with liquid aerosol-forming substrate. The cartridge may be replaceable in the aerosol-generating device. The aerosol-generating device may be reusable. The cartridge may be manufactured at low cost, in a reliable and repeatable fashion. As used herein, the term 'removably coupled' is used to mean that the cartridge and device can be coupled and uncoupled from one another without significantly damaging either the device or cartridge. The cartridge may have a housing within which an aerosol-forming substrate is held. The cartridge may comprise a lid. The lid may be peelable before coupling the cartridge to the aerosol-generating device. The lid may be piercable.

In at least one example embodiment, an aerosol-generating system comprises a housing and a heater assembly connected to the housing. The heater assembly comprises at least one heater and wick assembly according to any of the example embodiments described above. The heater assembly comprises an elongate support member connected to the housing and arranged to extend into the open-ended passage of a cartridge inserted in the cavity; and a plurality of heater and wick assemblies fixed to and spaced along the length of the elongate support member. The heater assembly may comprise a plurality of heater and wick assemblies. For example, the heater assembly may comprise two, three, four, five, six or more heater and wick assemblies fixed to and spaced along the length of the elongate support member.

In at least one example embodiment, the elongate support member may be formed by a hollow shaft portion defining an airflow passage forming part of an airflow pathway through the system. The at least one heater and wick assembly is supported by the hollow shaft portion such that it extends across the airflow passage transverse to the longitudinal axis of the hollow shaft portion. In such example embodiments, the at least one heater and wick assembly may span the airflow passage. Where one or more of the heater and wick assemblies extend across the airflow passage, the longitudinal axis of one or more of the heater and wick assemblies may be perpendicular to the longitudinal axis of the hollow shaft portion. One or more of the heater and wick assemblies extending across the airflow passage may be arranged such that its longitudinal axis is oblique to the longitudinal axis of the hollow shaft portion. Where the plurality of heater and wick assemblies extend across the airflow passage transverse to the longitudinal axis of the hollow shaft portion, one or more of the plurality of heater and wick assemblies may extend across the airflow passage such that its longitudinal axis is rotated about the longitudinal axis of the hollow shaft portion relative to the longitudinal axis of at least one other of the heater and wick assemblies. That is, when longitudinal axes of the heater and wick assemblies are projected onto a plane extending perpendicularly to the longitudinal axis of the hollow shaft portion, the longitudinal axis of one or more of the plurality of heater and wick assemblies may extend across the airflow passage at an angle to the longitudinal axis of at least one other of the heater and wick assemblies.

In at least one example embodiment, the elongate support member may be formed from an electrically conductive substrate, such as metal. The elongate support member may be formed from an electrically insulative substrate, such as a polymer substrate, and may further comprise one or more electrical conductors attached to the substrate for forming the heater and wick assemblies, for connecting the heater and wick assemblies to an electrical power source, or both. In at least one example embodiment, the elongate support member may comprise an electrically insulative substrate on which electrical conductors are applied for example by deposition, printing, or by laminating with the substrate as a laminated foil. The laminate foil may then be shaped or folded to form the elongate support member.

In at least one example embodiment, the plurality of heater and wick assemblies may extend across the airflow passage transverse to the longitudinal axis of the hollow shaft portion. In such example embodiments, the plurality of heater and wick assemblies may span the airflow passage.

In at least one example embodiment, the hollow shaft portion comprises a plurality of apertures in which a plurality of heater and wick assemblies are held, the plurality of heater and wick assemblies being in fluid communication with the storage portion heater and wick assemblies through the plurality of apertures. The apertures may be formed in the hollow shaft portion after the hollow shaft portion has been formed, for example by punching, drilling, milling, erosion, electro erosion, cutting, or laser cutting. The apertures may be formed integrally with the hollow shaft portion at the time of forming the hollow shaft portion, for example by casting or moulding the hollow shaft portion with the apertures or by a deposition process, such as electrodeposition.

In at least one example embodiment, the elongate support member has a proximal end attached to the housing and a distal end downstream from the proximal end. In any of the example embodiments described above, the elongate support member has a piercing surface at its distal end. Thus, the elongate support member may double as an elongate piercing member. This may allow the elongate support member to conveniently and easily pierce a seal at the end of a cartridge during insertion of the cartridge into the device. To facilitate piercing of the seal, the distal end of the elongate support member at which the piercing surface is located preferably has a cross-sectional area that is smaller than the cross-sectional area of the region of the elongate support member immediately proximal of the piercing surface. In at least one example embodiment, the cross-sectional area of the elongate support member narrows towards a tapered tip at the distal end of the elongate support member. The cross-sectional area of the elongate support member may narrow towards a point at the distal end of the elongate support member.

In at least one example embodiment, the aerosol-generating system may comprise an aerosol-forming chamber in which aerosol forms from a super saturated vapour, which aerosol is then carried into the mouth of a user. An air inlet, air outlet and the chamber are arranged so as to define an airflow route from the air inlet to the air outlet via the aerosol-forming chamber, so as to convey the aerosol to the air outlet.

The aerosol-generating system comprises an electrical power supply. The electrical power supply may be a battery. The battery may be a Lithium based battery, for example a Lithium-Cobalt, a Lithium-Iron-Phosphate, a Lithium Titanate or a Lithium-Polymer battery. The battery may be a Nickel-metal hydride battery or a Nickel cadmium battery. The power supply may be another form of charge storage device such as a capacitor. The power supply may require recharging and be configured for many cycles of charge and discharge. The power supply may have a capacity that allows for the storage of enough energy for the continuous generation of aerosol for a period of around six minutes, or for a period that is a multiple of six minutes. In another example embodiment, the power supply may have sufficient capacity to allow for a desired (or, alternatively predetermined) number of puffs or discrete activations of the heating means and actuator.

In at least one example embodiment, the aerosol-generating system may comprise a sensor configured to detect an activation of the system. The sensor may comprise a puff detector in communication with electric circuitry in the system. The puff detector may be configured to detect when an adult vaper draws on the system. The electric circuitry may be configured to control power to the heating element in dependence on the input from the puff detector. The electric circuitry may comprise a microprocessor, which may be a programmable microprocessor, a microcontroller, or an application specific integrated chip (ASIC) or other electronic circuitry capable of providing control. The electric circuitry may comprise further electronic components. The electric circuitry may be configured to regulate a supply of power to the heater and wick assembly. Power may be supplied to the heater and wick assembly substantially continuously following activation of the system or may be supplied intermittently, such as on a puff-by-puff basis. The power may be supplied to the heater and wick assembly in the form of pulses of electrical current.

In at least one example embodiment, the aerosol-generating system may comprise an input, such as a switch or button that turn the system on. The switch or button may activate the heater and wick assembly. The switch or button may initiate the aerosol generation. The switch or button may prepare electric circuitry to await input from a sensor, such as a puff sensor.

In at least one example embodiment, the aerosol-generating system may comprise a temperature sensor. The temperature sensor may be adjacent to the storage portion. The temperature sensor may be in communication with electric circuitry to enable the electric circuitry to maintain the temperature of the heating element at the predetermined operating temperature. The temperature sensor may be a thermocouple, or alternatively the heating element may be used to provide information relating to the temperature. The temperature dependent resistive properties of the heating element may be known and used to determine the temperature of the at least one heating element.

In at least one example embodiment, the system may comprise a housing defining a cavity for receiving an aerosol-generating article, such as a consumable cartridge. The housing may comprise a main body and a mouthpiece portion. The cavity may be in the main body and the mouthpiece portion may have an outlet through which aerosol generated by the device can be drawn. Alternatively, a mouthpiece portion may be provided as part of a cartridge. As used herein, the term "mouthpiece portion" means a portion of the device or cartridge through which an aerosol generated by the system exits the device. The heater and wick assembly may be connected to the main body or the mouthpiece portion.

Where the system comprises a housing defining a cavity for receiving an aerosol-generating article, the housing may be elongate. The housing may comprise any suitable material or combination of materials. Examples of suitable materials include metals, alloys, plastics or composite materials containing one or more of those materials, or thermoplastics that are suitable for food or pharmaceutical applications, for example polypropylene, polyetheretherketone (PEEK) and polyethylene. The material is light and non-brittle.

As used herein, the terms 'upstream' and 'downstream' are used to describe the relative positions of components, or portions of components, of aerosol-generating systems according to the invention in relation to the direction of air drawn through the aerosol-generating system. Air is drawn into the system at its upstream end, passes downstream through the system and exits the system at its downstream end. The terms 'distal' and 'proximal', are used to describe the relative positions of components of aerosol-generating systems in relation to their connection to the rest of the system, such that the proximal end of a component is at the 'fixed' end which is connected to the system, and the distal end is at the 'free' end, opposite to the proximal end. Where a component is connected to the system at the downstream end of the component, the downstream end may be considered as the 'proximal' end, and vice versa. The upstream and downstream ends of the cartridge and the aerosol-generating device are defined with respect to the airflow a draw is taken on the mouth end of the aerosol-generating device.

As used herein, the terms "longitudinal" and "length" refer to the direction between the opposed ends of a heater and wick assembly, or a component of an aerosol-generating system. The term "transverse" is used to describe the direction perpendicular to the longitudinal direction.

As used herein, the term "air inlet" is used to describe one or more apertures through which air may be drawn into the aerosol-generating system.

As used herein, the term "air outlet" is used to describe one or more aperture through which air may be drawn out of the aerosol-generating system.

At least one example embodiment, relates to a method of manufacturing a heater and wick assembly for an aerosol generating system. The method comprises the steps of: providing a capillary body, providing a support member extending along at least part of the length of the capillary body, arranging a heating element on an outer surface of the capillary body, and securing the heating element to the outer surface of the capillary body by fixing a pair of spaced apart electrical contacts around the capillary body and over the heating element.

In at least one example embodiment, the providing a capillary body may be carried out by providing a single length capillary body. The providing a support member extending along at least part of the length of the capillary body may be carried out by providing a single length support member. The arranging a heating element on an outer surface of the capillary body may be carried out by arranging a single length heating element on the single length capillary body. In such methods, each heater and wick assembly may be manufactured individually.

In at least one example embodiment, the providing a capillary body is carried out by providing a multi-length capillary body, the arranging a heating element is carried out by arranging a multi-length heating element on an outer surface of the multi-length capillary body, and the securing the heating element is carried out by fixing a plurality of pairs of spaced apart electrical contacts around the multi-length capillary body and over the multi-length heating element to secure the multi-length heating element to the outer surface of the multi-length capillary body. In at least one example embodiment, the method further comprises the step of cutting the multi-length capillary body and the multi-length heating element between adjacent pairs of electrical contacts to form a plurality of heater and wick assemblies. In some example embodiments, the providing a support member is carried out by providing a multi-length support member, and the cutting also includes cutting the multi-length support member between adjacent pairs of electrical contacts.

In at least one example embodiment, the step of securing the heating element is carried out by fixing one of the electrical contacts of each pair directly adjacent to one of the electrical contacts of the adjacent pair. Consequently, each pair is separated from the adjacent pair by only a small clearance. The cutting may then be carried out by cutting the multi-length capillary body and the multi-length heating element between the directly adjacent electrical contacts to form a plurality of heater and wick assemblies. The resulting heater and wick assemblies each have electrical contacts positioned at either end.

At least one example embodiment relates to a method of manufacturing a heater and wick assembly for an aerosol generating system. The method comprises: providing a capillary body, arranging a heating element on an outer surface of the capillary body, and securing the heating element to the outer surface of the capillary body by fixing a pair of spaced apart electrical contacts around the capillary body and over the heating element.

Features described in relation to one or more example embodiment may equally be applied to other example embodiments. In particular, features described in relation to the heater and wick assembly of the example embodiment may be equally applied to the aerosol-generating system of the second example embodiment, and vice versa, and features described in relation to either of the first and second example embodiments may equally apply to the method of manufacture of the third example embodiment.

Figure 1B:
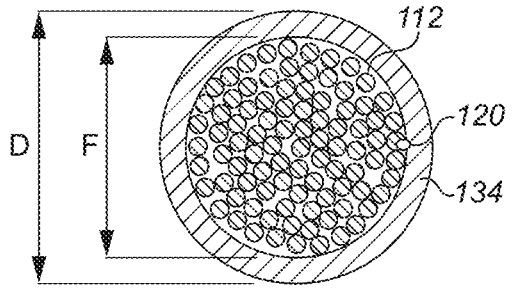
FIG. 1B is a transverse cross-sectional view of the heater and wick assembly of FIG. 1A taken along line 1B-1B in FIG. 1A according to at least one example embodiment.

FIGS. 1A and 1B illustrate an example embodiment of a heater and wick assembly 100 for an aerosol-generating system. The heater and wick assembly 100 comprises a capillary body 110, a heating element 120 arranged on an outer surface of the capillary body 110, and a pair of spaced apart electrical contacts 130 fixed around the capillary body 110 and over the heating element 120.

The capillary body 110, or capillary wick, comprises a plurality of fibres 112 through which an aerosol-forming liquid can be transported by capillary action. In this example embodiment, the plurality of fibres 112 are generally aligned along the length of the capillary body 110. In other example embodiments, the plurality of fibres may be woven or braided in a specific pattern. This allows the physical characteristics of the capillary wick, such as mechanical strength or capillarity, to be altered by using a particular pattern of fibres. It may also allow the capillary wick to maintain its shape and dimensions more effectively than with parallel fibres. The capillary body is compressible due to the existence of interstices between adjacent fibres. In this example embodiment, the capillary body 110 has rounded or domed end surfaces at both ends. This may help to increase the surface area between the capillary body 110 and an aerosol-forming liquid. In other example embodiments, the capillary body 110 may terminate at flat end surfaces.

The heating element 120 is formed from a coil of electrically resistive wire wound around the capillary body 110 and extending along an entire length of the capillary body 110. The wire may have any suitable cross-sectional shape. In at least one example embodiment, the wire has a round cross-sectional shape. In other example embodiments, the wire may have an oval, triangular, square, rectangular, or flat cross-sectional shape. This may increase heat transfer between the fibres 112 of the capillary body 110 and the wire of the heating element 120. The coil may have any suitable number of turns. In at least one example embodiment, the coil may have from about 2 to about 11 full turns between the electrical contacts 130 at either end. In at least one example embodiment, the coil has from about 3 to about 7 full turns between the electrical contacts 130.

The electrical contacts 130 comprise a first metallic ring 132 at a first end of the capillary body 110 and a second metallic ring 134 at a second end of the capillary body 110. The first and second metallic rings 132, 134 extend around the entire circumference of the capillary body 110 and over the heating element 120. The inner diameter of each of the metallic rings 132, 134 is less than the outer diameter of the capillary body 110. There is an interference fit between the metallic rings 132, 134 and the capillary body 110 underneath. This ensures that the metallic rings 132, 134 press into the capillary body 110 to secure the rings 132, 134 to the capillary body, with the heating element 120 retained between. This helps to ensure a reliable electrical connection between the electrical contacts 130 and the heating element 120. As the electrical contacts 130 extend around the entire circumference of the capillary body 110, it is not necessary to carefully match the rotational position of the electrical contacts with the position of the heating coil 120 during assembly to ensure an electrical connection.

As shown in FIGS. 1A and 1B, the heater assembly 100 has the following dimensions. The dimension H is a total length, defined by a maximum length of the capillary body 110. The dimension L is a spacing between the first and second metallic rings, 132, 134. The dimension W is a width of each of the first and second metallic rings, 132, 134. The dimension D is a diameter of the heater assembly 100, defined by the diameter of each of the first and second metallic rings, 132, 134. The dimension F is a diameter of the capillary body 110. The dimension P is a pitch of the coil of the heating element 120.

Table 1 below illustrates example ranges for values of each of dimensions D, F, H, L, P and W, for such heater and wick assemblies.

TABLE 1

| Dimension | D | F | H | L | P | W |
|---|---|---|---|---|---|---|
| Example range (mm) | 1.4-4.5 | 1-4 | 4-12 | 3.5-11 | 0.5-2 | 0.7-2.5 |
| Preferred range (mm) | 1.6-2.8 | 1.3-2.5 | 5-8 | 4-7 | 0.6-1.1 | 0.8-1.3 |

Figure 1C:
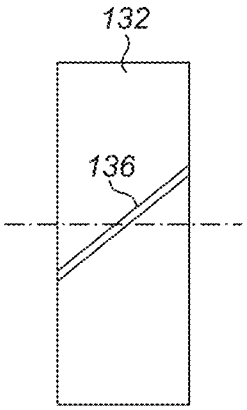
FIGS. 1C to 1E are side views of first, second and third electric contacts of the heater and wick assembly of FIG. 1A, with the other components of the assembly removed for clarity according to at least one example embodiment.
Figure 1D:
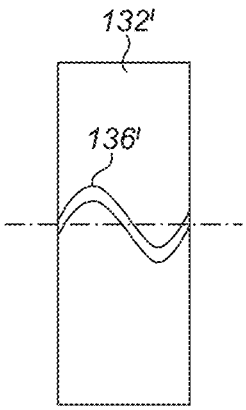
Figure 1E:
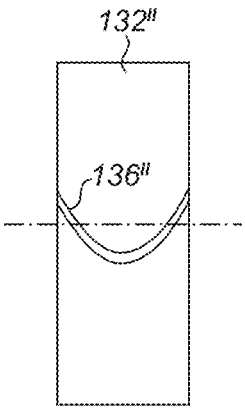

FIGS. 1C, 1D, and 1E show a side view of three example embodiments of metallic rings 132, 132', 132" for an electrical contact of the heater and wick assembly 100. In each of these example embodiments, the electrical contacts 130 are rigid and formed from a bent sheet of metal, the opposed ends of which are connected together at a joint 136. The joint between the opposed ends of the metallic ring differs in each of the example embodiments. As shown, the opposed ends of each electrical contact are co-operatively shaped such that the joint is non-linear or extends along an oblique line. This may help each of the electrical contacts to resist relative movement between its opposed ends in the length direction of the heater and wick assembly 100. In the example embodiment shown in FIG. 1C, the opposed ends of the ring 132 are co-operatively shaped so that the joint 136 extends along a straight, oblique line. In the example embodiment shown in FIG. 1D, the opposed ends of the ring 132' are co-operatively shaped so that the joint 136' is non-linear and has a wavy, or sinusoidal, shape. In the example embodiment shown in FIG. 1E, the opposed ends of the ring 132" are co-operatively shaped so that the joint 136" is non-linear and has a parabolic, or U-, shape. It will be appreciated that other shapes of joint are envisaged, such as V-shaped, zig zag shaped, or curved.

In the example embodiments shown in FIGS. 1A to 1E, the capillary body 110 has a generally circular cross-section and the electrical contacts 130 are in the form of circular rings. However, the capillary body 110 and electrical contacts may have any suitable cross-sectional shape. In at least one example embodiment, the capillary body and electrical contacts may have an oval, triangular, square, rectangular, or lozenge-shaped cross-section, as shown in FIG. 1F.

Figure 1F:
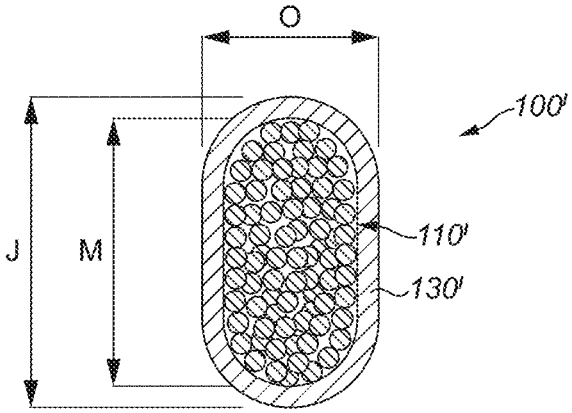
FIG. 1F is a transverse cross-sectional view of an alternative heater and wick assembly according to at least one example embodiment.

In at least one example embodiment, as shown in FIG. 1F, the heater and wick assembly 100' has a generally lozenge-shaped cross-section as defined by a lozenge-shaped capillary body 110' and lozenge shaped electrical contacts 130'. As shown in FIG. 1F, the heater assembly 100' has a height dimension J, a width dimension O, and a capillary body height dimension M which is equivalent to the height dimension J minus twice the thickness of the electric contact 130'. The dimensions J, M, and O may have any suitable value or range of values. In at least one example embodiment, dimension J may have a value of from about 1.4 mm to about 5.5 mm or from about 2.3 mm to about 3.1 mm, dimension M may have a value of from about 1.3 mm to about 5 mm or from about 2 mm to about 3 mm, and dimension O may have a value of from about 0.8 mm to about 3 mm or from about 0.8 mm to about 2.2 mm.

Figure 2A:
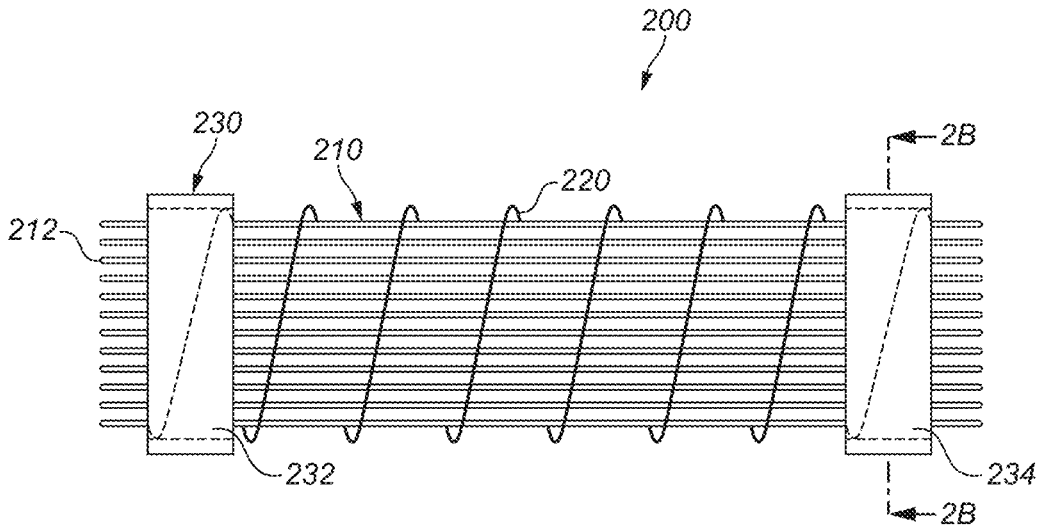
FIG. 2A is a side view of a heater and wick assembly according to at least one example embodiment.
Figure 2B:
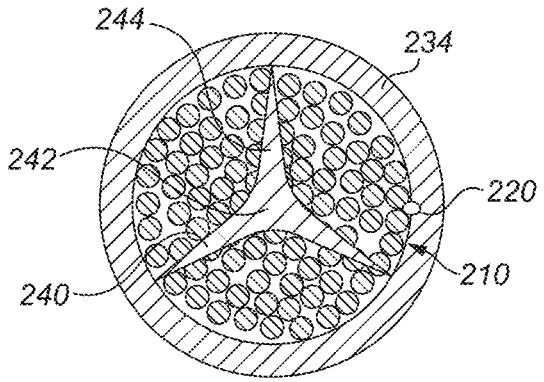
FIG. 2B is a transverse cross-sectional view of the heater and wick assembly of FIG. 2A taken along line 2B-2B in FIG. 2A according to at least one example embodiment.

FIGS. 2A and 2B illustrate at least one example embodiment of a heater and wick assembly 200 for an aerosol-generating system. The heater and wick assembly 200 FIG. 1A has a similar structure to the example heater and wick assembly 100 and where the same features are present, like reference numerals have been used. However, the heater and wick assembly 200 further includes a rigid support member 240 extending through the core of the capillary body 210 and surrounded by the fibres 212 of the capillary body 210.

In at least one example embodiment, as shown in FIG. 2B, the support member 240 is a single, unitary component with a solid cross-section formed from a central portion 242 and a plurality of transverse ribs 244 extending radially from the central portion 242. This cross-sectional shape provides the support member 240 with a relatively high transverse rigidity for a given cross-sectional area. Due to this, the space within the capillary body which is occupied by the support member 240 may be minimised and/or reduced so that the wicking ability, or capillarity, of the capillary body 210 may be largely unaffected by the presence of the support member 240. The transvers ribs 244 are tapered towards their tips. In at least one example embodiment, each of the transverse ribs 244 may have a width at its base of from about 0.3 mm to about 0.8mm or from about 0.3 mm to about 0.4 mm, and a width at its base of from about 0.1 mm to about 0.4 mm or from about 0.1 mm to about 0.2 mm.

In at least one example embodiment, the support member 240 extends along substantially the entire length of the capillary body 210 and is stronger and stiffer than the capillary body. Thus, the support member increases the strength and rigidity of the heater and wick assembly 200 to further improve robustness and ease of handling. In manufacturing operations in which individual heater and wick assemblies are cut from a multi-length heater and wick assembly, the support member may allow for improved accuracy of the cutting operation. This may lead to greater repeatability and consistency between different heater and wick assemblies.

In at least one example embodiment, in addition to increasing the bending strength and stiffness of the heater and wick assembly 200, the support member 240 also increases the density of the core of the capillary body 210. This may reduce the radial compressibility of the capillary body 210, thus helping to ensure a tight fit between the electrical contacts 230 and the heating element 220.

In at least one example embodiment, the support member 240 is formed from an electrical insulative material. This reduces the impact of the support member 240 on the electrical performance of the heating element 220 in the event of inadvertent contact between the heating element 220 and the support member 240.

The example dimensions of the heater assembly 200 are the same as described above in relation to other example embodiments. As with the first example heater assembly, the coil of the heating element 220 may have any suitable number of turns, for example from about 2 to about 11 full turns between the electrical contacts 230 or from about 3 to about 7 full turns between the electrical contacts 230.

Figure 3A:
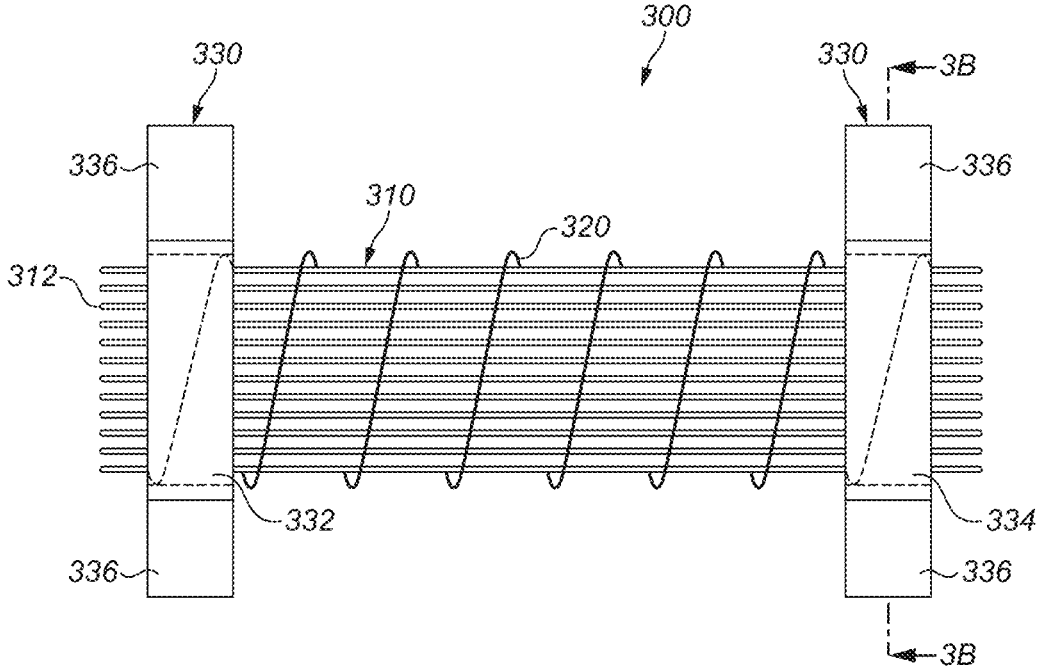
FIG. 3A is a side view of a heater and wick assembly according to at least one example embodiment.
Figure 3B:
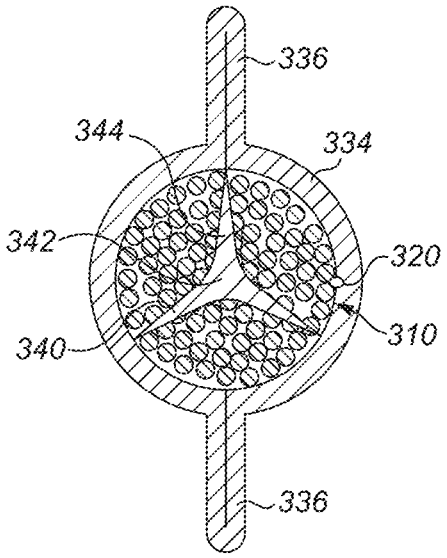
FIG. 3B is a transverse cross-sectional view of the heater and wick assembly of FIG. 3A taken along line 3B-3B in FIG. 3A according to at least one example embodiment.

FIGS. 3A and 3B illustrate at least one example embodiment of a heater and wick assembly 300 for an aerosol-generating system. The heater and wick assembly 300 has a similar structure to the heater and wick assembly 200 of the example embodiments described above, and where the same features are present, like reference numerals have been used. However, unlike the example heater and wick assembly 100 and the heater and wick assembly 200, the electrical contacts 330 each have outwardly extending, planar tabs 336 on opposite sides of the heater and wick assembly 300. The tabs 336 provide a flat surface with which the heater and wick assembly 300 may be located and retained within an aerosol-generating system. In at least one example embodiment, the tabs 336 may be received within one or more ports in an aerosol-generating system to allow the electrical contacts 330 to be fastened easily to the housing and in the correct position. The flat shape of the tabs 336 may also facilitate electrical connection of the electrical contacts to the power supply by presenting a larger electrically conductive surface area than with electrical contacts which do not have outwardly extending tabs.

The example dimensions of the heater assembly 300 are the same as described above in relation to the heater assembly 100 and the heater assembly 200. The coil of the heating element 320 may have any suitable number of turns, for example from about 2 to about 11 full turns between the electrical contacts 330, or from about 3 to about 7 full turns between the electrical contacts 330.

Heater and wick assemblies may be manufactured and assembled individually, for example by providing a single length capillary body and a single length support member, and arranging a single length heating element on the single length capillary body. Such a process may, for example, be carried out with the following steps. Step 1: Feed capillary fibres from a bobbin to form a continuous rod of fibres. Step 2A: Cut the continuous rod transversely to form a plurality of single length capillary bodies. Step 2B: Provide each of the plurality of single length capillary bodies with a single length support member extending along at least part of its length. Step 3: Unwind a length of electrically resistive wire from a bobbin and cut it to length. Step 4: Coil the cut length of wire around the single length capillary body and the support member to form the heating element. Step 5: Provide two sheets of electrically conductive material, either by unwinding from a bobbin and cutting to length or providing as a pre-cut segment. Step 6: Bend the sheets of electrically conductive material around the capillary body and over the heating element to form a spaced apart pair of electrical contacts in the form of clamping rings at either end of the capillary body. Step 7 (optional): Cut the capillary body to the correct length (if required) and shape one or both ends (if required, for example to provide rounded ends). Step 2B may be carried out before or after step 2A. In at least one example embodiment, where step 2B is carried out before step 2A, step 2B may carried out by arranging a continuous support member extending along the length of the continuous rod. In such examples, step 2B may be carried out by cutting both the continuous rod and the continuous support member transversely to form a plurality of single length capillary bodies each having a support member extending along at least part of its length.

Heater and wick assemblies may be manufactured and assembled by providing multi-length capillary body, having a length which is a multiple of the length of the capillary body of each heater and wick assembly, providing a multi-length support member, having a length which is a multiple of the length of the support member of each heater and wick assembly, and providing a multi-length heating element, having a length which is a multiple of the length of the heating element coil of each heater and wick assembly. This allows multiple heater and wick assemblies to be made more quickly. Such a process may, for example, be carried out with the following steps. Step 1A: Feed capillary fibres from a bobbin to form a continuous rod of fibres. Step 1B: Provide a continuous support member extending along the length of the continuous rod of fibres. Step 2: Feed a continuous electrically resistive wire from a bobbin and coil it around the continuous rod of fibres to form a continuous coil. Step 3: Provide a plurality of sheets of electrically conductive material, either by unwinding from a bobbin and cutting to length or providing as pre-cut segments. Step 4: Bend the sheets of electrically conductive material around the continuous rod of fibres and over the continuous coil to form a plurality of spaced apart pairs of electrical contacts in the form of clamping rings. Step 5: Cut the continuous rod of fibres, the continuous support member, and the continuous coil between adjacent pairs of electrical contacts to form a plurality of heater and wick assemblies. Step 6 (optional) shape one or both ends of each heater and wick assembly (if required, for example to provide rounded ends). Step 1B may be carried out before, after, or during step 1A.

Heater and wick assemblies according to at least one example embodiment may be manufactured in a fully automated process. The process may be carried out quickly and using standard equipment, such as that used in the pen industry and for electronics equipment. Using the processes described above, may allow assembly speeds of 4000 units/min.

Figure 4:
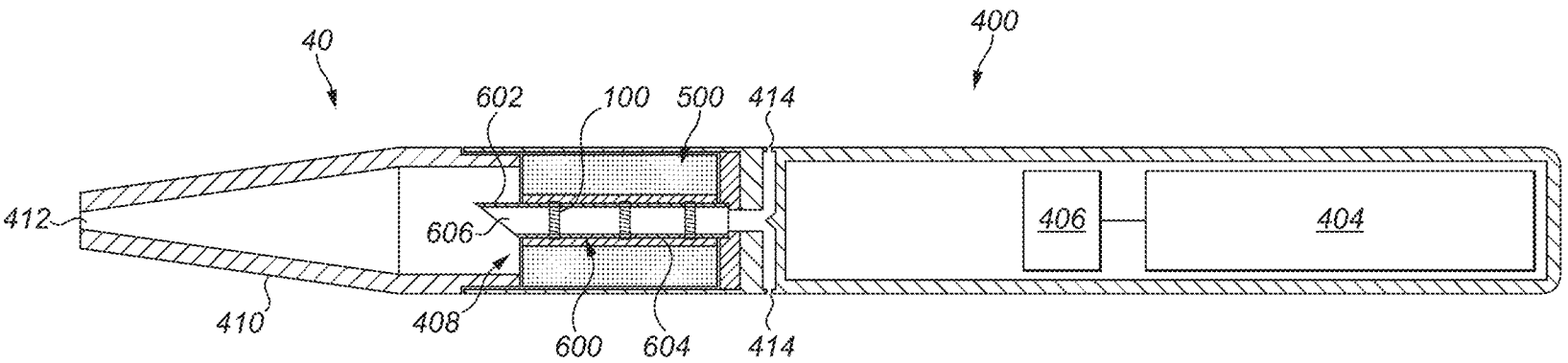
FIG. 4 is a schematic longitudinal cross-section of an aerosol-generating system according to at least one example embodiment.

FIG. 4 is a schematic illustration of an aerosol-generating system 40 incorporating a plurality of heater and wick assemblies according to at least one example embodiment. The aerosol-generating system 40 comprises an aerosol-generating device 400 and an aerosol-generating article in the form of a consumable cartridge 500.

In at least one example embodiment, the device 400 comprises a main housing 402 containing a battery 404 and control electronics 406. The housing 402 also defines a cavity 408 into which the cartridge 500 is received. The device 400 further includes a mouthpiece portion 410 including an outlet 412. In this example embodiment, the mouthpiece portion 410 is connected to the main housing 402 by a screw fitting, but any suitable kind of connection may be used, such as a hinged connection or a snap fitting. The device 400 further includes a heater assembly 600 comprising an elongate support member in the form of an elongate piercing member 602 connected to the housing 402 and a plurality of heater and wick assemblies 100 according to the first embodiment of the invention. The plurality of heater and wick assemblies are each supported by the piercing member 602. The elongate piercing member 602 is positioned centrally within the cavity 408 of the device 400 and extends along the longitudinal axis of the cavity 408. The piercing member 602 comprises a hollow shaft portion 604 defining an airflow passage 606. Air inlets 414 are provided in the main housing 402 upstream of the heater assembly 600 and are in fluid communication with the outlet 412 via the airflow passage 606. The heater assembly is discussed in more detail below in relation to FIGS. 6A to 6C.

Figure 5:
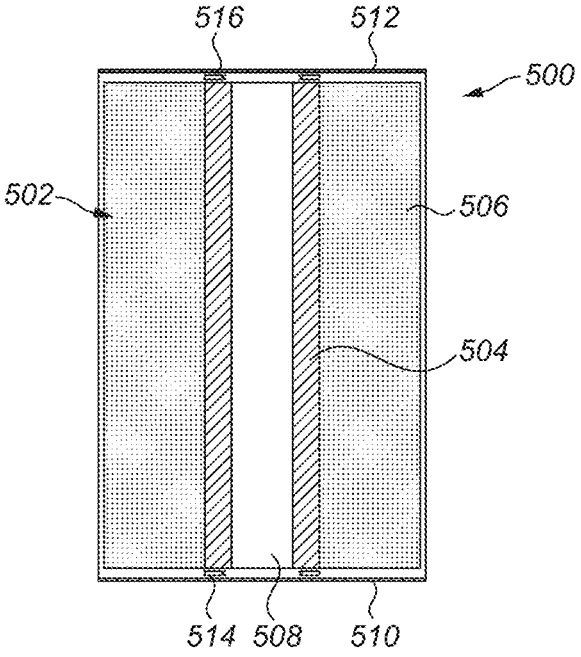
FIG. 5 illustrates a longitudinal cross-section of a consumable cartridge for the aerosol-generating system of FIG. 4 according to at least one example embodiment.

In at least one example embodiment, as best seen in FIG. 5, the cartridge 500 comprises a storage portion 502 including a tubular capillary wick 504 surrounded by a tubular capillary material 506 containing liquid aerosol-forming substrate. The cartridge 500 has a hollow cylindrical shape through which extends an internal passageway 508. The capillary wick 504 surrounds the internal passageway 508 so that the internal passageway 508 is at least partly defined by an inner surface of the capillary wick 504. The upstream and downstream ends of the cartridge 500 are capped by frangible seals 510, 512. The cartridge 500 further includes a sealing ring 514, 516 at each of the upstream and downstream ends of the internal passageway 508.

Figure 6A:
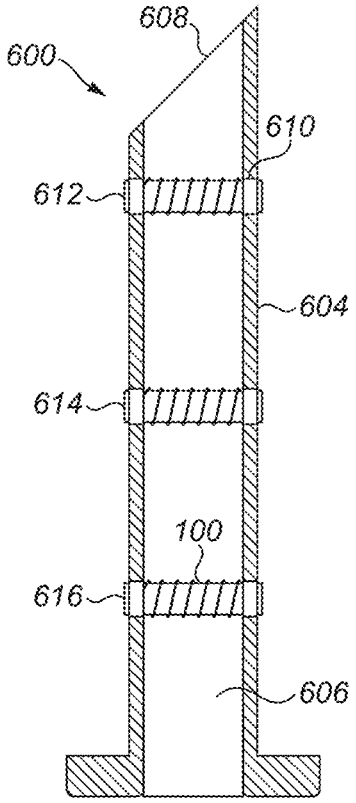
FIG. 6A is a schematic longitudinal sectional view of the heater assembly of the aerosol-generating system of FIG. 4 according to at least one example embodiment.
Figure 6B:
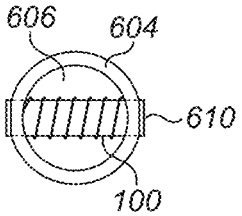
FIG. 6B illustrates a top view of the heater assembly of FIG. 6A according to at least one example embodiment.
Figure 6C:
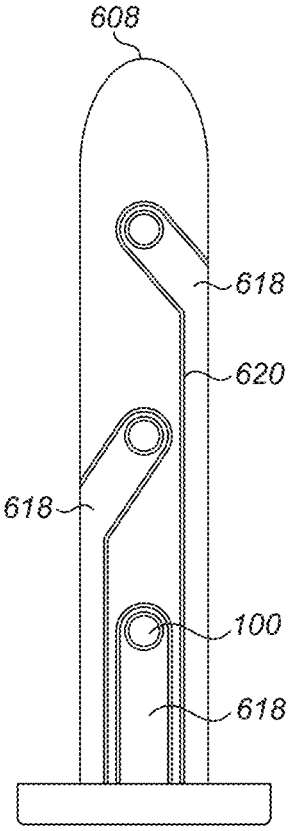
FIG. 6C illustrates a side view of the heater assembly of FIG. 6A according to at least one example embodiment.

In at least one example embodiment, as shown in FIGS. 6A, 6B and 6C, the hollow shaft portion 604 of the elongate piercing member 602 of the heater assembly 600 has a piercing surface 608 at its downstream end. In this example embodiment, the piercing surface 608 is formed by a sharp tip at the downstream end of the hollow shaft portion 604. The hollow shaft portion 604 has a plurality of apertures 610 within which the plurality of heater and wick assemblies 100 are held. The apertures 610 are provided in pairs, with each pair supporting a single electrical heater 100 at both of its ends. The two apertures in each pair are spaced apart around the circumference of the hollow shaft portion 604 so that each of the heater and wick assemblies 100 extends across the airflow passage 606. In this example embodiment, the plurality of apertures 610 comprises three pairs of apertures 612, 614, 616 supporting three heater and wick assemblies 100. The three pairs of apertures 612, 614, 616 are spaced apart along the length of the hollow shaft portion 604 and aligned around the circumference of the hollow shaft portion 604 such that the longitudinal axes of the three heater and wick assemblies 100 are parallel and rotationally aligned. It will be appreciated that other arrangements of heater assembly are envisaged. In at least one example embodiment, the hollow shaft portion may include two or more pairs of apertures, for example three, four, five, six, or seven or more pairs of apertures. The pairs or apertures may be arranged such that the longitudinal axis of one or more of the heater and wick assemblies is rotated by any suitable amount, such as 90 degrees, about the longitudinal axis of the hollow shaft portion relative the longitudinal axis of one or more of the other heater and wick assemblies. In some example embodiments, the heater and wick assemblies may be arranged in a helix or spiral around the hollow shaft portion.

In at least one example embodiment, the hollow shaft portion 604 is at least partially divided into a plurality of electrically isolated sections 618 which are electrically connected to the device 400. The apertures 610 in the hollow shaft portion 604 are each formed in one of the electrically isolated sections 618. In this manner, the heater and wick assemblies 100 held in the plurality of apertures 610 are electrically connected to the device 100. The electrically isolated sections 618 are electrically isolated from each other by insulating gaps 620. Thus, the heater and wick assemblies 100 may be electrically isolated from the each other to allow separate operation, control, or monitoring, without the need for separate electrical wiring for each heater. In this example embodiment, the gaps 620 are air gaps. That is, the gaps 620 do not contain insulating material. In other example embodiments, one or more of the gaps 320 may be filled or partially filled with an electrically insulating material.

In at least one example embodiment, the electrical contacts of the heater and wick assemblies 100 and the apertures 610 in the piercing member 602 are co-operatively sized to provide a frictional fit. This ensures a secure fit between the hollow shaft portion 604 and the heater and wick assemblies 100. This may also enable a good electrical connection to be maintained between the heating element of each heater and wick assembly and the battery in the device 400. In at least one example embodiment, the apertures 610 are circular to match the shape of the electrical contacts of the heater and wick assemblies 100. In at least one example embodiment, the cross-sectional shape of the electrical contacts may be different and the shape of the apertures determined accordingly. In at least one example embodiment, where the heater and wick assemblies have outwardly extending tabs, as with the example embodiments of heater and wick assembly discussed above in relation to FIGS. 3A to 3C, the apertures 610 may have corresponding notches (not shown) which form ports into which the tabs may be received. Alternatively, or in addition, the piercing member 602 may include one or more clips in which the tabs may be located and retained.

Figure 7A:
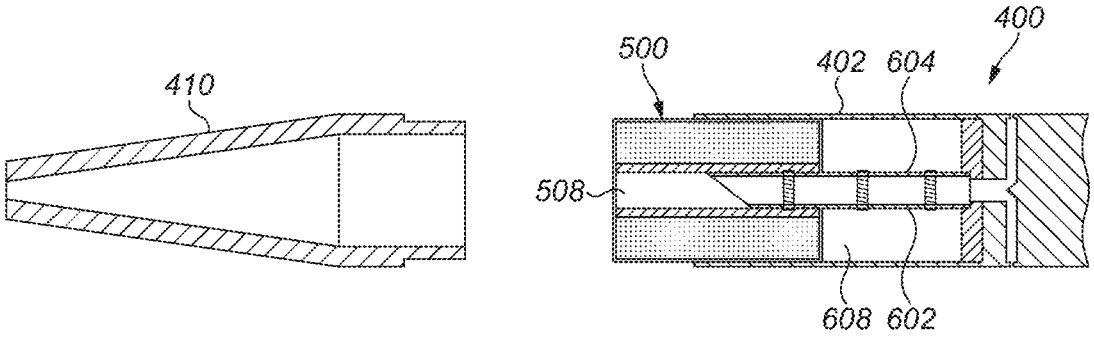
FIGS. 7A and 7B illustrate a method of inserting a consumable cartridge into the aerosol-generating device of the aerosol-generating system of FIG. 4 according to at least one example embodiment.
Figure 7B:
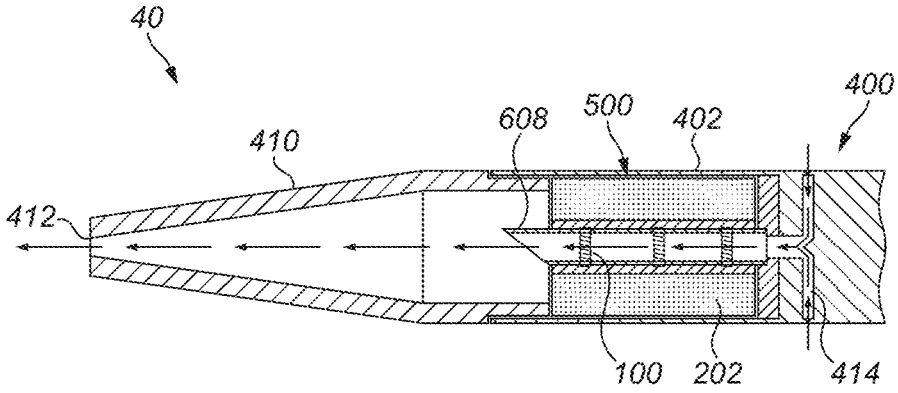

In at least one example embodiment, referring to FIGS. 7A and 7B, insertion of the cartridge 500 into the device 400 of the system 40 is described. To insert the cartridge 500 into the device 400, and thereby assemble the system 40, the first step is to remove the mouthpiece portion 410 from the main housing 402 of the device 400 and to insert the article 500 into the cavity 408 of the device 400, as shown in FIG. 7A. During insertion of cartridge 500 into the cavity 408, the piercing surface 608 at the distal end of the piercing member 602 breaks the frangible seal at the upstream end of the cartridge 500. As the cartridge 500 is inserted further into the cavity 408 and the piercing member 602 extends further into the internal passageway 508 of the cartridge, the piercing surface 608 engages with and breaks through the frangible seal at the downstream end of the cartridge 500 to create a hole in the frangible seal.

In at least one example embodiment, the cartridge 500 is then fully inserted into the cavity 408 and the mouthpiece portion 410 is replaced onto the main housing 402 and engaged thereto to enclose the cartridge 500 within the cavity 408, as shown in FIG. 7B. When the cartridge 500 is fully inserted into the cavity 408, the holes in the frangible seals at the upstream and downstream ends of the cartridge 500 each have a diameter approximately equal to the outer diameter of the hollow shaft portion 604. The sealing rings at the upstream and downstream ends of the cartridge 500 form a seal around the hollow shaft portion 604. Together with the frangible seals this reduces and/or substantially prevents leakage of liquid aerosol-forming substrate from the cartridge 500 and out of the system 40. The cartridge 500 may be pressed fully into the cavity 408 by the user before the mouthpiece portion 410 is replaced onto the main housing 402. In at least one example embodiment, the cartridge 500 may be partially inserted into the cavity 408 and the mouthpiece portion 410 used to push the cartridge 500 into the cavity 408 until it is fully inserted.

In at least one example embodiment, as shown in FIG. 7B, when the cartridge 500 is fully inserted into the cavity 408 of the aerosol-generating device 400, an airflow pathway, shown by arrows in FIG. 7B, is formed through the aerosol-generating system 40. The airflow pathway extends from the air inlets 414 to the outlet 412 via the internal passageway 508 in the cartridge 500 and the airflow passage 606 in the heater assembly 600. As also shown in FIG. 7B, when the cartridge 500 is fully inserted, the heater and wick assemblies 100 are in fluid communication with the storage portion 502 of the cartridge 500 at the inner surface of the internal passageway 508.

In at least one example embodiment, during vaping, liquid aerosol-forming substrate is transferred from the storage portion 502 to the capillary body of each heater and wick assembly 100 via capillary action and through the plurality of apertures in the piercing member 602. In at least one example embodiment, the outer diameter of the hollow shaft portion 604 of the elongate piercing member 602 is greater than the inner diameter of the internal passageway 508 of the cartridge 500 so that the storage portion 502 of the cartridge 500 is compressed by the hollow shaft portion 604. This ensures direct contact between the ends of the heater and wick assemblies 100 and the storage portion 502 to help transfer of liquid aerosol-forming substrate to the heater and wick assemblies 100. The battery supplies electrical energy to the heating element of each heater and wick assembly 100, via the piercing member 602 and the electrical contacts of each heater and wick assembly 100. The heating elements heat up to vaporise liquid substrate in the capillary body of the heater and wick assemblies 100 to create a supersaturated vapour. At the same time, the liquid being vaporised is replaced by further liquid moving along the capillary wick of the liquid storage portion 502 and the capillary body of each heater and wick assembly 100 by capillary action. (This is sometimes referred to as "pumping action".) When the mouthpiece portion 410 is drawn upon, air is drawn through the air inlets 414, through the airflow passage of the hollow shaft portion 604, past the heater and wick assemblies 100, into the mouthpiece portion 410 and out of the outlet 412. The vaporised aerosol-forming substrate is entrained in the air flowing through the airflow passage of the hollow shaft portion 604 and condenses within the mouthpiece portion 410 to form an inhalable aerosol, which is carried towards the outlet 412.

In at least one example embodiment, the device may be operated by a manually operated switch (not shown) on the device 400. Alternatively, or in addition, the device may include a sensor for detecting a puff. When a puff is detected by the sensor, the control electrics control the supply of electrical energy from the battery to the heater and wick assemblies 100. The sensor may comprise one or more separate components. In some example embodiments, the puff sensing function is performed by the heating elements of the heater and wick assemblies. In at least one example embodiment, by measuring with the control electronics one or more electrical parameters of the heating elements and detecting a particular change in the measured electrical parameters which is indicative of a puff.

The example embodiment described above, illustrate but do not limit the invention. It is to be understood that other example embodiments may be made and the example embodiments described herein are not exhaustive.

I claim:

1. A heater and wick assembly for an aerosol generating system, the assembly comprising:
- a capillary body;
- a heating element arranged on an outer surface of the capillary body;
- a pair of spaced apart electrical contacts fixed around the capillary body and coupled with the heating element, each electrical contact of the pair of spaced apart electrical contacts including a first tab extending in a first direction perpendicular to a length of the capillary body and a second tab extending in a second direction perpendicular to the length of the capillary body, the second direction opposite the first direction; and
- a support member extending along at least part of a length of the capillary body, the support member surrounded by the capillary body.

2. The heater and wick assembly according to claim 1, wherein at least one of the electrical contacts is dimensioned such that there is a frictional fit between an inner surface of that electrical contact and the outer surface of the capillary body.

3. The heater and wick assembly according to claim 1, wherein at least one of the electrical contacts extends around at least part of a circumference of the capillary body and is dimensioned such that there is an interference fit between the electrical contact and the capillary body.

4. The heater and wick assembly according to claim 1, wherein one or both of the electrical contacts extend around substantially an entire circumference of the capillary body.

5. The heater and wick assembly according to claim 1, wherein one or both of the electrical contacts is rigid.

6. The heater and wick assembly according to claim 1, wherein the heating element comprises a coil of electrically resistive wire wound around the capillary body.

7. The heater and wick assembly according to claim 1, wherein the capillary body is elongate and the pair of electrical contacts comprises a first electrical contact at or adjacent to a first end of the capillary body and a second electrical contact at or adjacent to a second end of the capillary body.

8. The heater and wick assembly according to claim 1, wherein the support member is rigid.

9. The heater and wick assembly according to claim 1, wherein the support member extends along substantially an entire length of the capillary body.

10. The heater and wick assembly according to claim 1, wherein the support member has a solid cross-sectional area.

11. The heater and wick assembly according to claim 1, wherein the support member comprises a central portion and a plurality of transverse ribs.

12. The heater and wick assembly according to claim 1, wherein the support member is formed from an electrically insulative material.

13. An aerosol-generating system comprising:
- a heater and wick assembly according to claim 1;
- a liquid storage portion in fluid communication with the capillary body; and
- an electric power supply connected to the heating element via the electrical contacts.

14. The heater and wick assembly according to claim 1, wherein the first tab and the second tab of each pair of spaced apart electrical contacts include a planar surface.

15. The aerosol-generating system according to claim 13, wherein the aerosol-generating system is an electrically heated smoking system.

16. A method of manufacturing a heater and wick assembly for an aerosol generating system, the method comprising:
- providing a capillary body;
- providing support member extending along at least part of a length of the capillary body, the support member surrounded by the capillary body;
- arranging a heating element on an outer surface of the capillary body; and
- securing the heating element to the outer surface of the capillary body by fixing a pair of spaced apart electrical contacts around the capillary body and over the heating element, each electrical contact of the pair of spaced apart electrical contacts including a first tab extending in a first direction perpendicular to a length of the capillary body and a second tab extending in a second direction perpendicular to the length of the capillary body, the second direction opposite the first direction.

17. The method according to claim 16, wherein:
- the providing a capillary body includes providing a multi-length capillary body,
- the arranging a heating element includes arranging a multi-length heating element on an outer surface of the multi-length capillary body, and
- the securing the heating element includes fixing a plurality of pairs of spaced apart electrical contacts around the multi-length capillary body and over the multi-length heating element to secure the multi-length heating element to the outer surface of the multi-length capillary body.

* * * * *